United States Patent [19]

Tyler

[11] 3,984,806

[45] Oct. 5, 1976

[54] LOCATION SYSTEMS

[75] Inventor: Ronald Arthur Tyler, Chelmsford, England

[73] Assignee: The Marconi Company Limited, Chelmsford, England

[22] Filed: June 6, 1975

[21] Appl. No.: 584,596

[30] Foreign Application Priority Data

June 8, 1974 United Kingdom ..... 25523/74

[52] U.S. Cl. ..... 340/23; 340/152 R; 235/150.27

[51] Int. Cl.[2] ..... G08G 1/12

[58] Field of Search ..... 340/23, 24; 235/150.27

[56] References Cited

UNITED STATES PATENTS 3,568,161 3/1971 Knickel ..... 340/24

3,849,636 11/1974 Helms ..... 340/24

3,886,515 5/1975 Cottin ..... 340/23

*Primary Examiner*—Thomas B. Habecker

*Attorney, Agent, or Firm*—Baldwin, Wight & Brown

[57] ABSTRACT

A vehicle location system for vehicles travelling over a predetermined route in which equipment in the vehicle derives information concerning the distance travelled from predetermined junctions and the turns made and computing means within the vehicle computes the route between road junctions on which the vehicle is travelling. Each vehicle carries transmitter means for transmitting computed location information to a base station when interrogated by the same.

12 Claims, 8 Drawing Figures

Figures 1, 2:
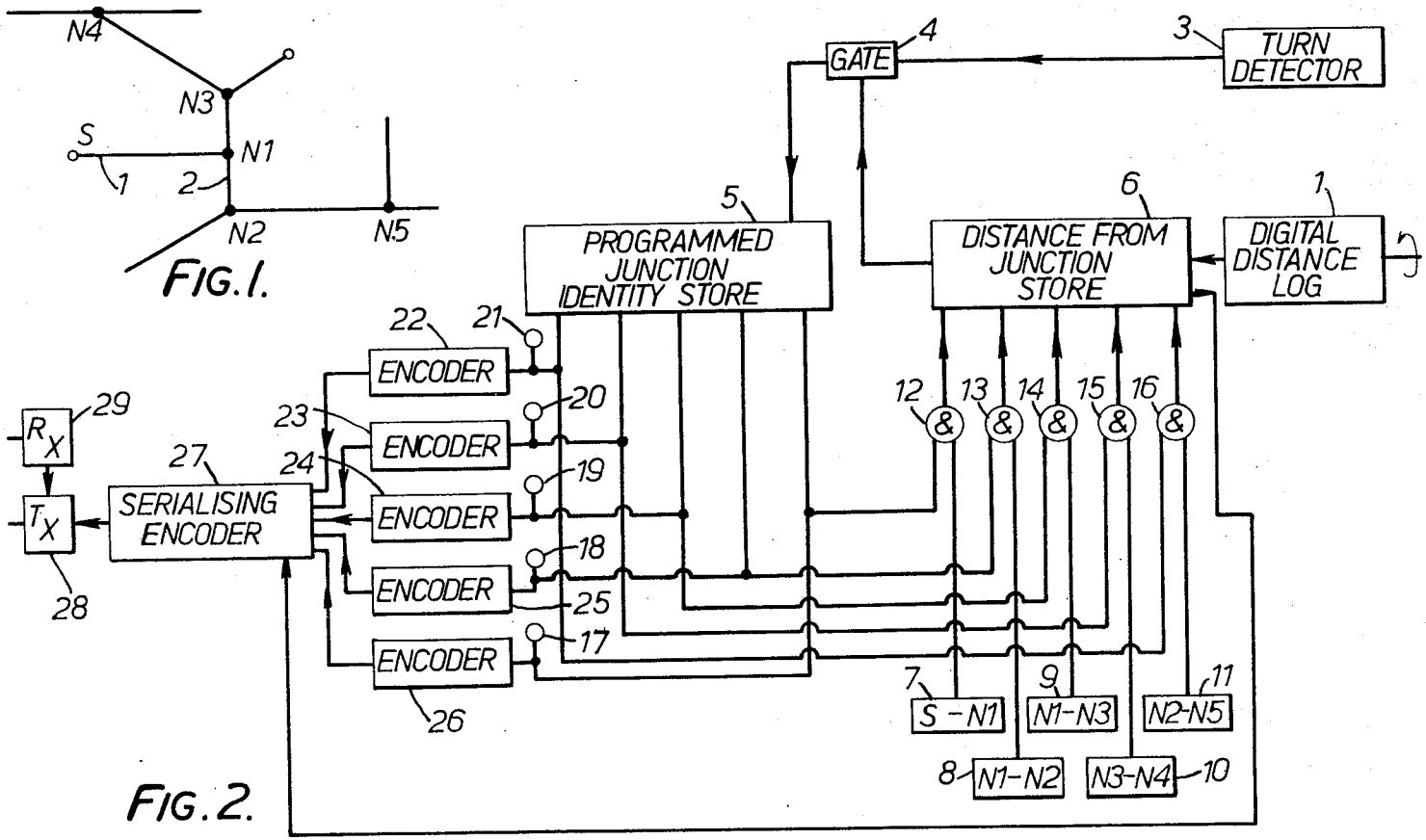

TURN DETECTOR
DIGITAL DISTANCE LOG
DISTANCE FROM JUNCTION STORE
GATE
PROGRAMMED JUNCTION IDENTITY STORE
ENCODER
SERIALISING ENCODER
RX
TX
N1
N2
N3
N4
N5
S

LOCATION SYSTEMS

This invention relates to vehicle location and more particularly to apparatus and systems for locating vehicles travelling over a predetermined network of vehicle routes.

Whilst particularly applicable to wheeled vehicles travelling over networks of routes, the invention is not limited to this application.

According to this invention, a vehicle location apparatus for providing data concerning the position of a vehicle when said vehicle is travelling over a predetermined network of routes comprises means for deriving information signals relating to the distance travelled by said vehicle, means for deriving information signals relating to changes in the direction of travel of said vehicle, means for storing signals relating to the identity of a given junction as determined by the appropriate turn characteristics of the junction preceding it, means for storing signals relating to the distance between junctions and means for computing from said derived information signals and said stored signals, data concerning the location of said vehicle on said network.

Preferably said means for deriving information signals relating to the distance travelled by said vehicle is such as to provide a digital output which is connected to reduce the count in a digital store (hereinafter called a "distance-from-junction" store) which is arranged initially to contain a count appropriate to the distance between the junction last negotiated by the vehicle and the junction to which the vehicle is heading.

Preferably again said distance-from-junction store is connected to open, when its count attains zero, a gate thereby to connect said means for deriving information signals relating to changes in the direction of travel of said vehicle to a programmed junction identity store which, in dependence upon the characteristics of the signal received from said last mentioned means, provides an output which is indicative of the junction to which the vehicle is now heading. Normally said last mentioned programmed identity store is arranged to control the writing in to the distance-from-junction store of a count from an appropriate one of a number of permanent stores each storing a digital number corresponding to the distance between each given and preceding junctions.

Not only may means be provided for indicating, under the control of said programmed junction identity store, the junction towards which the vehicle carrying the apparatus is currently heading and the count of said distance-from-junction store, but also means are normally provided for transmitting this last mentioned data to a monitoring base station, preferably upon receipt of an interrogating signal from said monitoring base station.

In a system in accordance with the present invention in which a plurality of mobile vehicles each carries apparatus as described above, preferably a base monitoring station is arranged to interrogate each mobile apparatus utilising an interrogating signal which is unique to that apparatus and each apparatus includes means for transmitting data concerning its location to said monitoring station upon receipt and detection of its unique interrogating code.

Often the monitoring base station will be arranged to interrogate each mobile apparatus in the system, sequentially and in turn.

Figure 3:
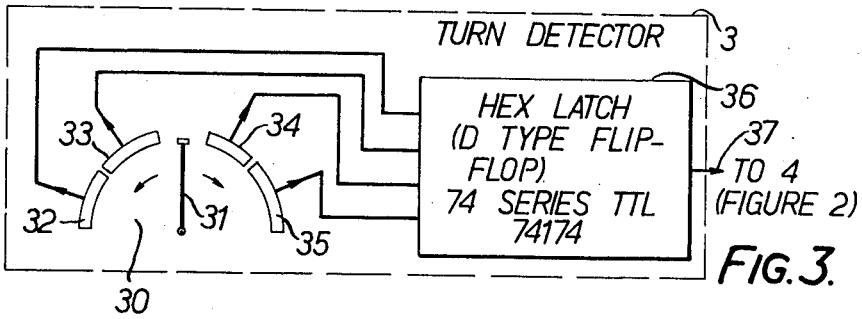
Figure 4:
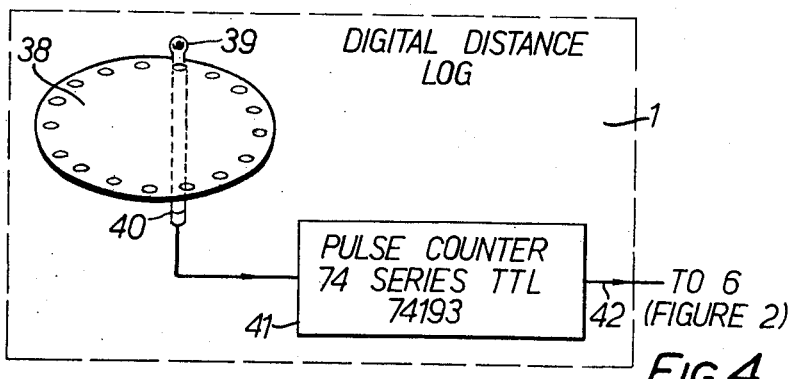
Figure 5:
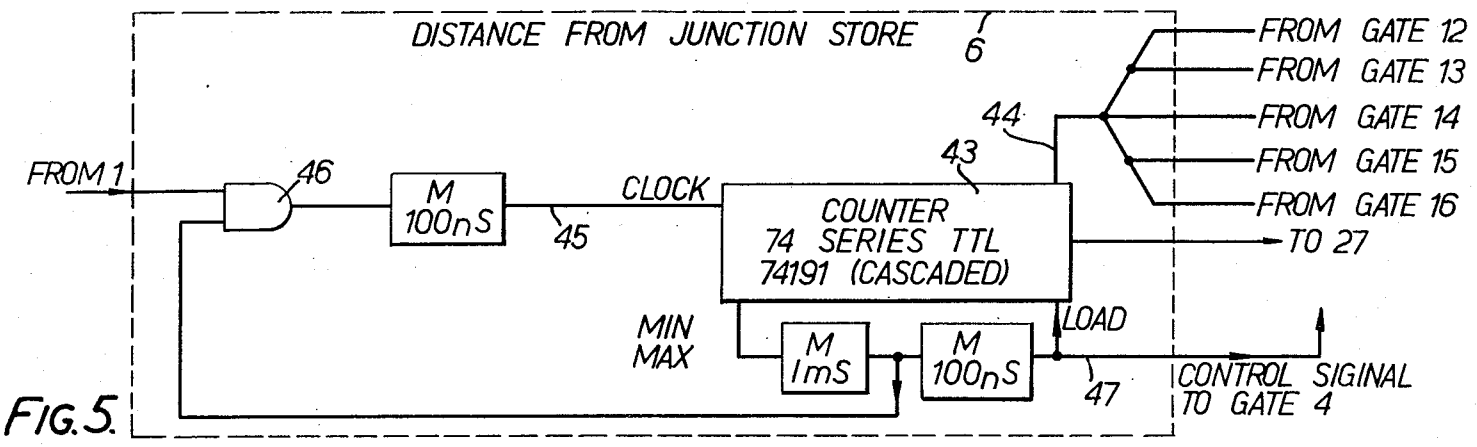
Figure 8:
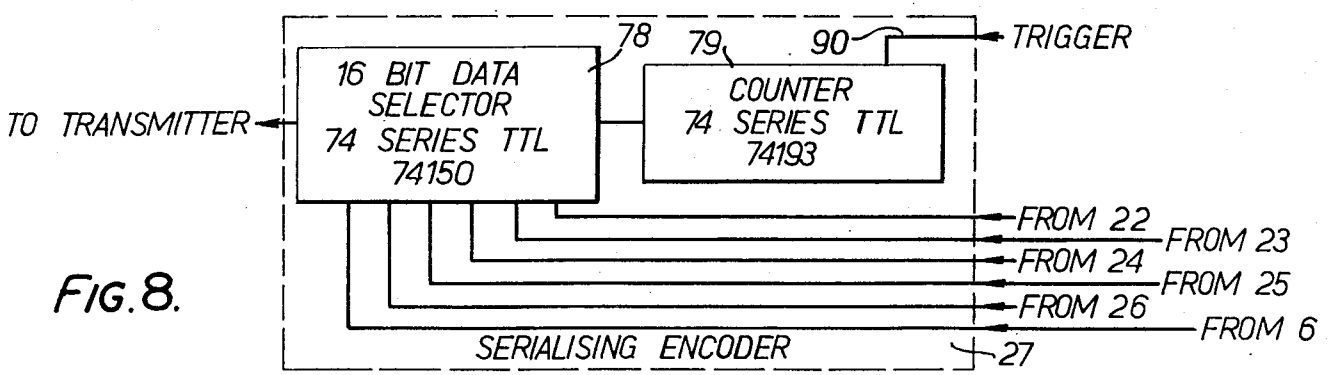
Figure 6:
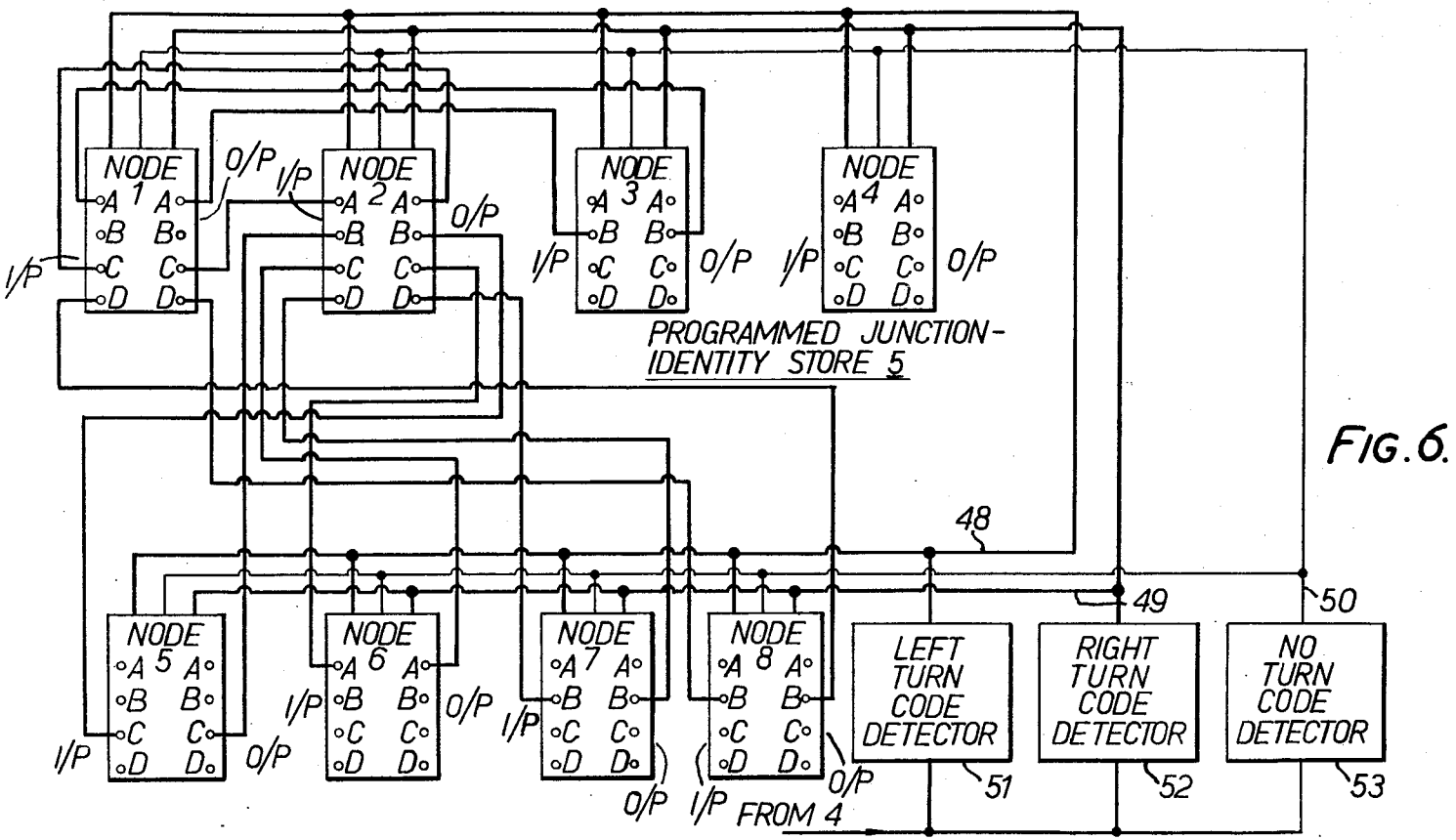
Figure 7:
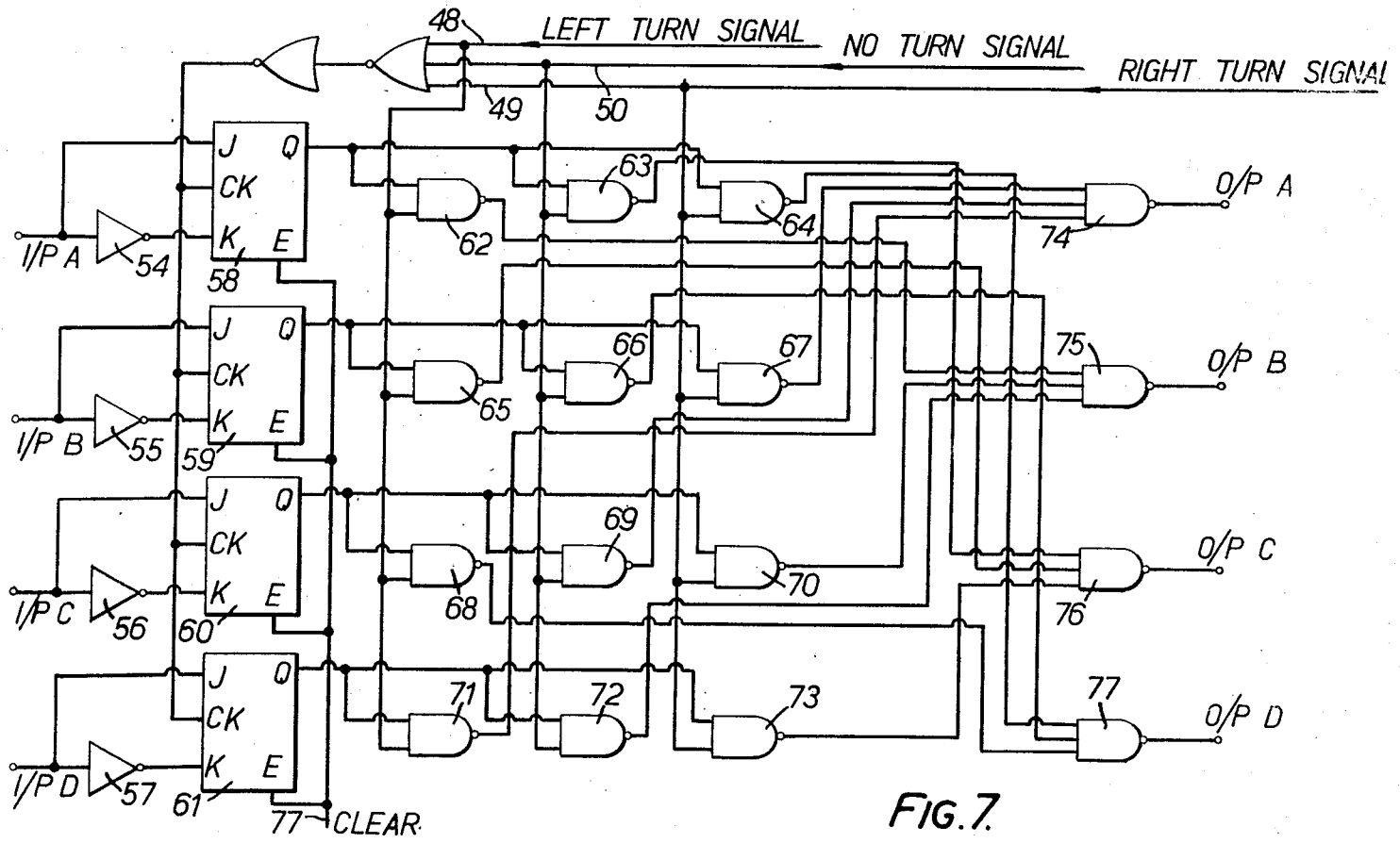

The invention is illustrated in and further described with reference to FIGS. 1 to 8 of the accompanying drawing in which, FIG. 1 is a diagram of a simple road network, FIG. 2 is a block diagram of a vehicle borne apparatus in accordance with the present invention, FIG. 3 schematically represents in greater detail turn detector referenced 3 in FIG. 2, FIG. 4 schematically represents in greater detail digital distance log referenced 1 in FIG. 2, FIG. 5 schematically represents in greater detail distance-from-junction store referenced 6 in FIG. 2, FIG. 6 schematically represents in greater detail programmed junction identity store referenced 5 in FIG. 2, FIG. 7 schematically represents in greater detail each individual logic circuit in FIG. 6 and FIG. 8 schematically represents in greater detail the serialising encoder referenced 27 in FIG. 2.

Referring to FIG. 1, the network consists of a number of roads such as 1, 2 extending between junctions N1 to N5 at which two or more roads join. S is an arbitrarily chosen starting point from which a vehicle carrying the equipment of FIG. 2 is to be tracked. S may or may not be the location of a base station provided to monitor the vehicle borne equipment.

Referring to FIG. 2, information concerning the distance travelled by the vehicle is derived from a digital distance log 1 driven, as represented by the arrow 2, in synchronism with the road wheels of the vehicle (assuming the vehicle to be wheeled). Turn information is derived from a turn detector 3 which in the simplest case may be connected to the steering gear of the vehicle to provide indication of left or right turn. Usually in practice, indication of the extent of such turn is also provided. Output from the turn detector 3 is applied via a gate 4, which is normally closed, to a programmed junction identifying store 5, the nature of which will be apparent presently.

Output signals from the digital distance log 1 are applied to a distance-from-junction store 6 in order to cause this store to count down. The initial count of store 6 is representative of the distance from a junction the vehicle last negotiated to the junction the vehicle is approaching. An output signal is derived from the distance-from-junction store 6 when the count in that store becomes zero, which output signal is applied to open gate 4.

The initial count written into store 6 is derived from one of a number of permanent memory stores 7 to 11, via AND gates 12 to 16, when those gates are opened under the control of the programmed junction identity store 5. Permanent memory store 7 records the distance between the starting point S and the first junction N1, store 8 the distance between junction N1 and junction N2, store 9 the distance between junction N1 and N3, store 10 the distance between junction N3 and N4 and store 11 the distance between junction N2 and N5.

Programmed junction identifying store 5 is programmed such that from the initial starting point S, and assuming a heading towards N1, output signals are provided to open gate 12 and so write into distance-from-junction store 6, a count representing the distance between the starting point S and the junction N1. At the same time an indication is provided, visually for example on an indicator 17, that the junction to which the vehicle is heading is junction N1. Upon receipt of turn information received from turn detector 3, via gate 4, programmed junction identifying store 5 computes the junction to which the vehicle is now heading, e.g. junction N2, and opens the appropriate AND gate, in this case AND gate 13, in order to enter into distance-from-junction store 6, a count representing the distance between junctions N1 and N2. At the same time the indication of the junction to which the vehicle is heading is changed from N1 to N2, by the de-energizing of indicator 17 and the energizing of an appropriate indicator 18. Other indicators 19, 20 and 21 are provided in respect of headings towards respective ones of the remaining junctions.

As has already been mentioned, gate 4 is only opened as the count of distance-from-junction store 6 is reduced to zero. This provides, as it were, a range gate with the object of ensuring that the turn information applied to programmed junction identifying store 5 is turn information relating to the vehicle's manoeuvre at the junction. In practice the turn information derived at the vehicle is integrated over a distance such that the turn information transmitted to the base station relates to the overall manoeuvre and tends to ignore any unavoidable changes in steering direction which may be made during the manoeuvre.

Thus at any time indicators 17 to 21 controlled by programmed identity junction 5 provide an indication of the junction to which the vehicle is heading, whilst the count in distance from junction to store 6 provides an indication of the distance the vehicle is to travel to reach the junction.

In order to permit the location of the vehicle carrying the equipment of FIG. 2 to be monitored by a base station, the appropriate outputs of programmed junction identity store 5 are not only connected to energise appropriate ones of the indicators 17 to 21, but also to trigger appropriate ones of a plurality of digital encoders 22 to 26. The outputs of encoders 22 to 26 are connected, together with a signal representing the count in distance-from-junction store 6 to a serialising encoder 27. This serialising encoder 27 is capable of providing an output signal corresponding to the current position of the vehicle carrying the equipment. The output of serialising encoder 27 is connected to a transmitter 28 arranged to be triggered under the control of a receiver 29, when that receiver receives an interrogating signal from the monitoring base station.

Where, as would normally be the case in practice, a plurality of vehicles are to be tracked by a monitoring station over a given network of roads, use would be made of a "round-robin" interrogation and reply technique (for example, as set out in the specification of our UK Patent number 1,310,679) in which each of the vehicles is interrogated in turn. In such a case the receiver 29 in any one vehicle would be provided with a detector capable of decoding a coded signal transmitted by the base station which indicated that the base station wished to interrogate that particular vehicle.

Since in this case it is the mobile station itself which computes its position and is therefore (unless there is a malfunction, of course) in a position at any time to provide this information to the monitoring station, the quality of the communications link between each mobile station and a base station and the time interval between successive interrogations of the same vehicle are not of prime importance.

So far as the digital distance log 1 of FIG. 2 is concerned in a practical case, the use of a shaft encoder is envisaged which would provide 1,024 increments every five miles, so as to provide a resolution in the distance indication of approximately 26 feet for a change of one unit in the least significant digit. In order to reduce the amount of data transmission time utilised by any one vehicle, the change of heading during manoeuvre may be regarded as a step function. In some cases, for example, in addition to indicating whether the turn is to the left or to the right, it may only be necessary in a practical system to identify the degree of turn in steps of 22½°, or even 45°, in order for the programmed junction identifying store 5 to compute the junction to which the vehicle is heading after a manoeuvre. Whilst the turn detector 3 may be driven direct from the steering mechanism of the vehicle as previously described, an alternative method would be to compare the difference in wheel revolutions between an inside and an outside wheel, which occurs as a vehicle is involved in a turning manoeuvre.

Referring to FIG. 3, the turn detector 3 of FIG. 2, in this particular example is such as to provide electrical signals representative of turns from 15° to 45° left, of greater than 45° left, from 15° to 45° right and of greater than 45° right. To achieve this a rotary switch 30 is provided, which has a wiper 31 movable clockwise or anti clockwise from a median position shown in dependence upon movement of the steering gear of the vehicle to contact one of four arcuate contacts 32, 33, 34 and 35. Each of the arcuate contacts 32 to 35 is connected to an input of a "hex latch" 36 otherwise called a D type flip flop, (74 series TTL logic circuit reference 74174). The output of hex latch 36 is connected to a lead 37 which corresponds to the lead shown between turn detector 3 and gate 4 in FIG. 2.

Referring to FIG. 4, in essence the digital distance log in this particular example consists of a perforated disc 38 which is rotated in synchronism with the road wheels of the vehicle. The apertures in the disc 38 are arranged to move between an illuminating source 39 and a photo-electric detector 40, which latter thus produces a system of pulses whose pulse repetition frequency corresponds to the speed of the vehicle. The output of photo-electric detector 40 is connected to a pulse counter 41, which may, for example be a 74 series TTL logic circuit reference 74193. The output of pulse counter 41 is connected to lead 42 which corresponds to the lead between digital distance log 1 and distance-from-junction store 6 in FIG. 2.

Referring to FIG. 5, in this particular example distance-from-junction store 6 consists essentially of a digital counter 43 comprised, for example, of a required number of 74 series TTL logic circuits reference 74191 connected in cascade. The counter 43 derives its initial count from input lead 44 which, as represented, is connected to each of the AND gates 12 to 16 in FIG. 2. The initial count of counter 43 is reduced by clock signals applied via lead 45 which is connected to the output of digital distance log 1 of FIG. 2 via a gate 46. As the stored count of counter 43 is reduced to zero a control signal is made available on lead 47 which is connected to control the opening of gate 4 of FIG. 2. At the same time clock signals from digital distance log 1 of FIG. 2 are temporarily inhibited by gate 46. Following the opening of gate 4, programmed junction identity store 5 of FIG. 2 causes the appropriate one of gates 12 to 16 of FIG. 2 to open in order to load counter 43 with a count corresponding to the next inter-junction distance.

Referring to FIGS. 6 and 7, these show in detail logic circuitry which may form an implementation of programmed junction identity store 5 of FIG. 2. Alternatively of course this store may be realised by a suitably programmed computer. The circuit shown in FIG. 7 represents the logic which would be required for each of the "node" blocks 1 to 8 in FIG. 6. One node block would be provided for each road junction. In this example, for ease of showing, only direction of turn (to left or right) is considered without distinction being made between degrees of turn. The additional logic required to take into account degrees of turn will, it is believed, be self evident. Each node is allowed four ports (A, B, C, D as shown in FIG. 6) which may or may not all be used. One circuit as shown in FIG. 7 would be provided for each node block and these circuits would be connected together as exemplified in FIG. 6 to form a pattern corresponding to the road network.

Referring specifically to FIG. 7, it will be seen that each input A, B, C and D is connected directly to the J input, and via an inverter bistable circuit 55, 56 and 57 respectively, to the K input of a JK bistable circuit 58, 59, 60 or 61. The Q output of JK bistable circuit 58 is connected to one input terminal of each of three AND gates 62, 63 and 64. The Q output terminal of JK bistablecircuit 59 is similarly connected to one input of each of three AND gates 65, 66 and 67. The Q output terminal of JK bistable circuit 60 is connected to one input of each of three AND gates 68, 69 and 70. The Q output terminal of JK bistable circuit 61 is connected to one input terminal of each of three AND gates 71, 72 and 73. The second input terminal of each of AND gates 62, 65, 68 and 71 is connected to the "left turn signal" line 48. The second input terminal of each of AND gates 63, 66, 69 and 72 is connected to the "no turn signal" line 50. The second input of each of AND gates 64, 67, 70 and 73 is connected to the "right turn signal" line 49. Four output AND gates 74, 75, 76 and 77 are provided, the outputs of which are connected respectively to output terminals A, B, C and D. Each AND gate 74 to 77 has three input terminals. The input terminals of AND gate 74 are connected respectively to the output terminals of AND gates 67, 69 and 71. The input terminals of AND gate 75 are connected respectively to the output terminals of AND gates 62, 70 and 72. The input terminals of AND gate 76 are connected respectively to the output terminals of AND gates 63, 65 and 73. The input terminals of AND gate 77 are connected respectively to the output terminals of AND gates 64, 66 and 68.

The E terminal of each of the JK bistable circuits 58 to 61 is connected to a "Clear" lead in order to enable the bistable circuits to be cleared for initialisation purposes.

Each of the inverters 54 to 57 may comprise one type SN 7404 logic circuit. Each JK bistable circuit 58 to 61 may comprise two type SN 74107 logic circuits. Each AND gate 62 to 73 may comprise a type SN 7400 logic circuit. Each AND gate 74 to 77 may comprise two type SN 7410 logic circuits. The left turn signal lead 48, right turn signal lead 49 and no turn signal lead 50 are also connected via an OR gate and inverter to the CK terminals of the bistable circuits 58 to 61. Within the system of FIG. 6, of the bistable circuits 58 to 61 in all of the node blocks 1 to 8 only one bistable circuit would be energised (Q output logically true). This indicates that the vehicle is approaching the junction to which corresponds the node block containing that bistable circuit. The particular bistable circuit within the node block denotes the particular entry route to the junction. When a vehicle arrives at a junction either the "turn left" line 48 or the "turn right" line 49 or the "no turn" line 50 would be energised depending upon which of three detectors 51, 52 or 53 responded to the output of gate 4. Detector 51 is a left turn code detector, detector 52 is a right turn code detector and detector 53 is a no turn code detector. This energises, via the matrix, one of the outputs of the node block in which the bistable circuit is set which will in turn energise another bistable circuit in another node block and de-energise the original. Thus bistable circuits will be energised sequentially and will follow the progress of the vehicle.

Referring to FIG. 8, the serialising encoder 27 consists essentially of a 16 bit data selector 78 (for example a 74 series TTL logic circuit reference 74150) which is connected to derive inputs from encoders 22 to 26 of FIG. 2 and from the distance-from-junction store 6 of FIG. 2. The data selector 78 is arranged to be clocked by a counter 79 (for example a 74 series TTL logic circuit reference 74193) which is triggered by a trigger signal on line 80 derived from receiver 29 of FIG. 2 when the latter detects an interrogating signal from the base monitoring station which is appropriate to the particular mobile apparatus.

I claim:

1. A vehicle location apparatus for providing data concerning the position of a vehicle when said vehicle is travelling over a predetermined network of routes comprising distance log means for producing information signals relating to the distance travelled by said vehicle, turn detector means for producing information signals relating to changes in the direction of travel of said vehicle, junction identity means for storing signals relating to the identity of a given junction as determined by the appropriate turn characteristics of the junction preceding it, and distance from junction store means for storing signals relating to the distance between junctions, said junction identity means including means for computing the next junction toward which said vehicle is headed on said network.

2. An apparatus as claimed in claim 1 and wherein said distance from junction store includes a digital store containing a count indicating the distance to the junction toward which the vehicle is heading and said distance log means provides a digital output which is connected to reduce the count in said digital store.

3. An apparatus as claimed in claim 2 and wherein said digital store is connected to open, when its count attains zero, a gate thereto to connect said turn detector means to said junction identity means.

4. An apparatus as claimed in claim 3 and wherein said junction identity store means is arranged to control the writing in to said digital store of a count from an appropriate one of a number of permanent stores in said distance from junction store means each storing a digital number corresponding to the distance between each given and preceding junctions.

5. An apparatus as claimed in claim 3 and wherein means are provided for indicating, under the control of said junction identity store means, the junction towards which the vehicle carrying the apparatus is currently heading and the count of said digital store.

6. An apparatus as claimed in claim 3 and wherein means are provided for transmitting the count of said digital store and data concerning the junction towards which the vehicle carrying the apparatus is currently heading to a monitoring base station.

7. An apparatus as claimed in claim 6 and wherein the arrangement is such that said last mentioned data is transmitted to said monitoring base station upon receipt of an interrogating signal from said monitoring base station.

8. A system wherein a plurality of mobile vehicles each carries apparatus as claimed in claim 1 and wherein a base monitoring station is arranged to interrogate each mobile apparatus utilising an interrogating signal which is unique to that apparatus and each apparatus includes means for transmitting data concerning its location to said monitoring station upon receipt and detection of its unique interrogating code.

9. A system as claimed in claim 8 and wherein said monitoring base station is arranged to interrogate each mobile apparatus in the system, sequentially and in turn.

10. A vehicle location apparatus for providing data concerning the position of a vehicle when said vehicle is travelling over a predetermined network of routes which defines a number of junctions, comprising in combination:

a bank of storage devices containing data indicating the known distances between adjacent junctions of said network;

temporary storage means for temporarily storing data from one of said storage devices at a time;

gate means connecting said bank of storage devices to said temporary storage means to permit the temporary storing of data in the latter;

means slaved to the vehicle and connected with said temporary storage means for causing the latter to produce an enabling signal when the distance travelled by the vehicle matches that stored in said temporary storage means;

vehicle turn indicating means producing output signals indicating change of direction, if any, of the vehicle;

programmed junction identity means connected to said output signals of the turn indicating means for computing the next junction of said network toward which the vehicle is heading and having a plurality of output lines controlling said gate means to cause said temporary storage means to store the information indicating the distance to said next junction; and said enabling signal controlling the application of said output signals of the turn indicating means whereby said junction identity means computes the identity of said next junction only upon arrival of the vehicle at that junction toward which it was originally heading.

11. Apparatus as defined in claim 10 wherein said temporary storage means comprises a counter which initially contains a count indicating the distance to the junction toward which the vehicle is heading and which is counted down by said means slaved to the vehicle.

12. Apparatus as defined in claim 11 wherein said programmed junction identity means comprises a logic network corresponding to the vehicular route network.

* * * * *